US005847492A

United States Patent [19]

Frantello

[11] Patent Number: 5,847,492

[45] Date of Patent: Dec. 8, 1998

[54] SPARK PLUG

[76] Inventor: Alfred A. Frantello, 4000 N. Riverside Suite 206, Satellite Bch, Fla. 32937

[21] Appl. No.: 801,949

[22] Filed: Feb. 18, 1997

[51] Int. Cl.[6] ..... H01T 13/20

[52] U.S. Cl. ..... 313/141; 313/139; 313/142

[58] Field of Search ..... 313/141, 139, 313/142

[56] References Cited

U.S. PATENT DOCUMENTS

| | | | |
|---|---|---|---|
| 1,674,977 | 5/1928 | McElroy | 313/141 |
| 1,992,071 | 4/1935 | Healey | 313/139 |
| 4,206,381 | 6/1980 | Wax | 313/139 |
| 4,267,481 | 5/1981 | Sauder | 313/139 |

*Primary Examiner*—Nimeshkumar Patel
*Attorney, Agent, or Firm*—John B. Dickman, III

[57] ABSTRACT

A spark plug having the electrodes composed of twisted stainless steel wire with their spark gap ends frayed so as to give more spark contacting area, reduce heat and eliminate wear on the electrodes, thus giving a stronger, more efficient spark and more efficient combustion of the fuel-air mixture in the cylinders. A sealing means is also incorporated in the interior of the plug to prevent escape of any combustion products. The frayed ends will vibrate during the firing cycle, which will shake off any carbon which may tend to accumulate on them. A modification shows the ends of the wires not frayed but solid and clean cut.

8 Claims, 2 Drawing Sheets

SPARK PLUG

BACKGROUND OF THE INVENTION

This invention relates to spark plugs, and specifically to spark plugs of the type having a plurality of electrodes.

The spark plug field is replete with plugs of all types, most show a single centrally located electrode which accepts the positive charge and a single electrode attached to the screw in base portion which carries the negative charge. This is true in negative ground systems, the center electrode carries the positive current, in positive ground systems the reverse is true, however most of our automotive and internal engine electrical systems today are negatively ground systems. The flow of electrons in this example is from negative to positive, thus creating a spark between these wires and igniting the fuel-air mixture in the engine.

In prior plugs having only one positive and one negative wire, the heat generated by the spark and the high voltage, gradually the tips of the positive and negative wires were eroded, making it necessary to "regap" the space between the wires at regular intervals, since the most efficient combustion of fuel occurs when the space or gap between the negative and positive wires is a specific distance.

The present invention solves these prior problems by forming the positive and negative electrodes from twisted stainless steel wires, one from showing the wires being specifically frayed at the spark gap area to allow the spark to have a multiplicity of contact points, another form showing the wires cut clean and evenly, tightly compacted at the spark gap area. This will, of course reduce the generated heat and result in positive ignition of the fuel with no erosion of points, so no "regapping" will be necessary at regular intervals as with conventional plugs.

OBJECTS OF THE INVENTION

It is therefore a primary object of the present invention to provide a spark plug which will give a stronger and more positive spark.

A further object of the invention is to provide a plug which will never need "gapping", said "gapping" being done during manufacture.

A further object is to provide a spark plug which will result in complete combustion of the fuel.

A further object of the invention is to provide a plug with less heat generation and no erosion at the spark gap area.

Other and further objects and advantages will appear from the following detailed description and claims.

Figure 1:
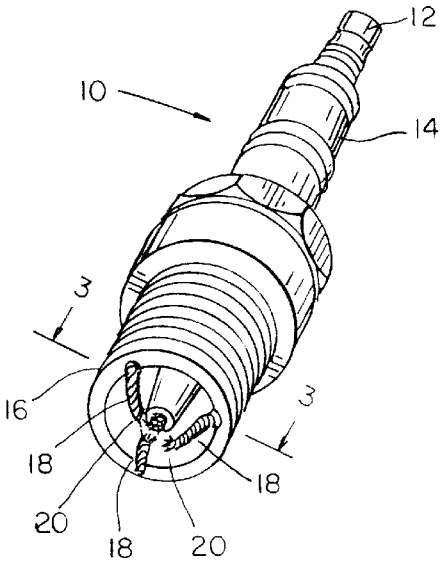
FIG. 1 shows a perspective view of a spark plug of my invention.
Figure 2:
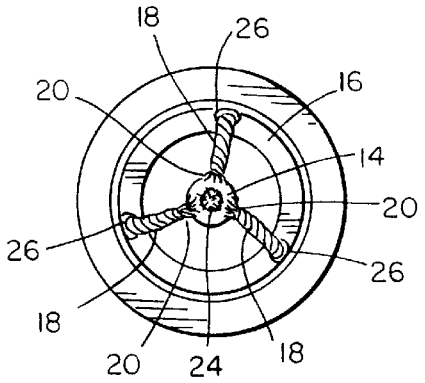
FIG. 2 is a bottom view of the plug.

Referring to the drawings in detail, a spark plug generally designated by the numeral 10, includes a terminal 12 for connection to an ignition wire, a porcelain or other suitable hollow insulating core 14, a metal threaded base 16, twisted stainless steel wire negative electrodes 18 welded or otherwise attached to metal base 16 at 26 and having frayed spark contacting portions 20, and a center twisted stainless steel wires positive electrode 22, having a frayed spark contacting portion 24 thereon.

In operation, the plug 10 is screwed into the engine block in the normal manner, an ignition wire (not shown) is attached to the terminal 12 and the plug is ready for operation. When the ignition key of the vehicle is turned on, the air and gasolene mixture will flow onto the top pistons, the current will flow from negative electrodes 18 to positive electrodes 22 through the frayed ends of the wires 18 and 22, causing a powerful spark to occur and ignite the air-gas mixture on the top pistons.

A sealing means may be used to prevent combustion products from seeping through the interior of the plug around the insulation as shown by numeral 28. One means of sealing the restricted passageway within the plug is to drip several drops of water glass or other suitable material into space 28 and bake the plug in an oven for several minutes to harden the material, which material is non-conductive and will also function as an insulating means.

Figure 4:
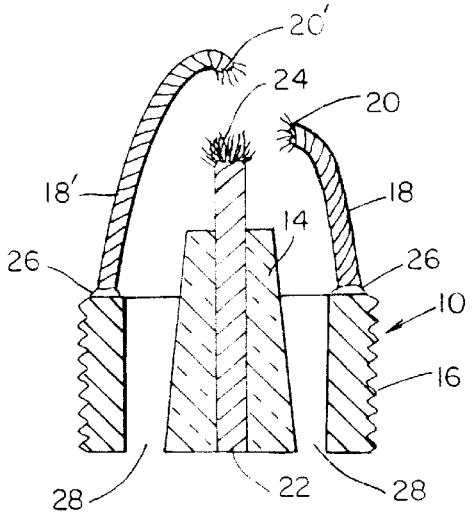
FIG. 4 is a section taken on the line 3—3 of FIG. 1 showing the modification of a longer negative end.
Figure 3:
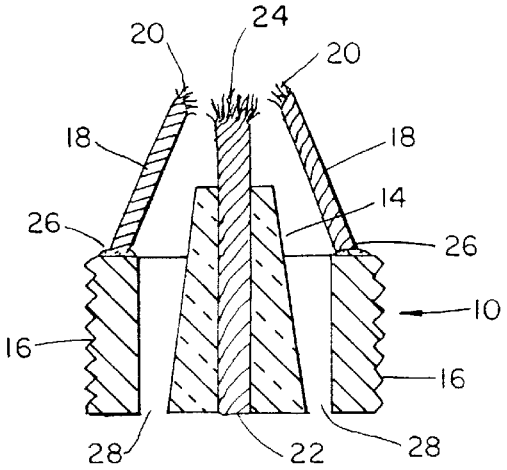
FIG. 3 is a section taken on line 3—3 of FIG. 1.
Figure 5:
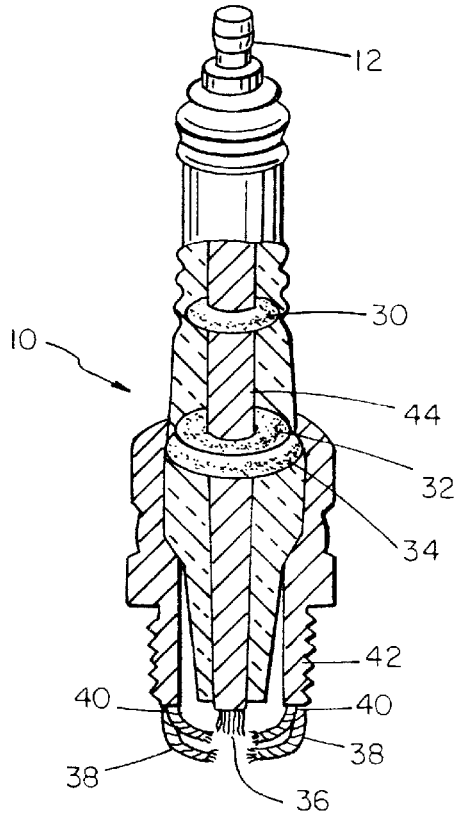
FIG. 5 is a section showing another modification.

A modification is shown in FIG. 4, where one or more of the outer negative electrodes 18' extends higher than the center positive electrode so that it's frayed spark plug portion 20' is facing downwardly toward the frayed spark plug portion 24 on the center electrode. Other modifications showing one or more positive and negative electrodes oriented at various angles to each other are believed to be within the purview of the present specification and claims. A further modification is shown in FIG. 5, showing the plug 10, the terminal 12, the sealing rings 30, 32 and 34, the positive electrode 44 having it's terminal end 36, the negative electrodes 38 and 40, and the ferrous threaded base 42.

Figure 6:
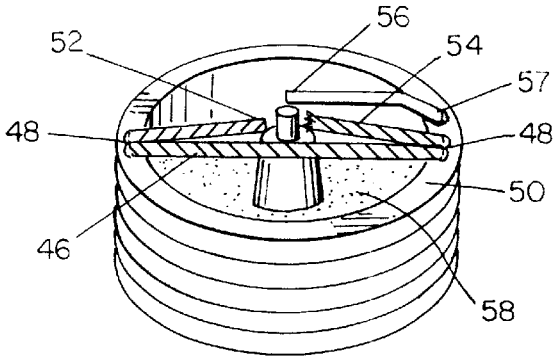
FIG. 6 shows another modification.

A still further modification of the invention is shown in FIG. 6. This figure shows continuous, tightly twisted, stainless steel wires 46, attached at two or more points 48 to a hardened steel spark plug base 50, said twisted stainless steel wires then extending from said spark plug base towards said center electrode 36 and terminating at a suitably spaced distance from said center electrode. The end 52 is tightly wound with no open strands, the other end 54 has open strands.

Numeral 56 shows the firing end of the negative electrode as presently found on most standard spark plugs, the other end 57 being attached to the hardened sparkplug base 50.

Figure 7:
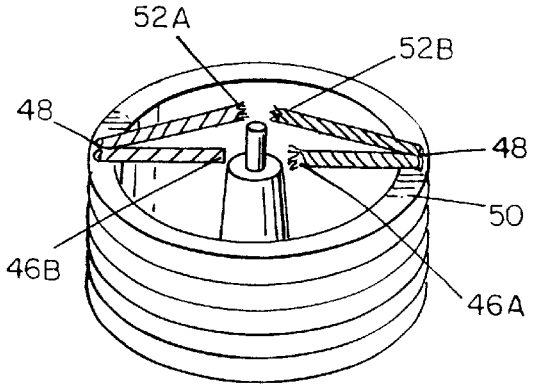
FIG. 7 shows still another modification.

As with all the other forms of my invention, a sealing means 58 is applied between the center electrode 36 and the hardened steel base 50. The sealing means can be water glass or any suitable material A still further modification of the invention is shown in FIG. 7. This figure shows continuous tightly twisted stainless steel wires 46 attached at two or more points 48 to the hardened steel spark plug base 50, said twisted stainless wires then extend from said spark plug base towards the said center electrode 36 and terminating at a suitable spaced distance from said center electrode 36. End 46A is frayed, end 46B is blunt, end 52A is frayed, end 52B is blunt, these specific configurations assure that complete combustion of the fuel occurs.

I claim:

1. A spark plug for igniting a fuel-air mixture having upper and lower ends, comprising an outer ferrous metal shell having a threaded portion on it's lower end, an inner core or insulating material having a bore therethrough fitting tightly within said shell and extending above and below said shell, a center electrode comprising a length of twisted stainless steel wires fitting tightly within the bore in the insulating material and extending completely therethrough from said upper end to said lower end, said center electrode extending beyond the lower threaded shell portion and having it's extreme lower end portion frayed and suitably spaced from said threaded shell portion, at least one of the twisted stainless steel double ended wires having one of it's ends attached to the lower end of said threaded shell portion and having it's other end frayed and spaced from the frayed end of the center electrode, whereby when ignition occurs, the spark to ignite the fuel-air mixture will bridge the frayed ends of the central electrode and the wire attached to the end portion of the threaded shell and cause combustion.

2. A spark plug as set forth in claim 1 in which the core of insulating material comprises a porcelain compound.

3. A spark plug as set forth in claim 2 in which said core of insulating material has a non-conductive sealant interposed between it and the outer ferrous metal shell.

4. A spark plug as set forth in claim 3 in which the electrode on the outer ferrous metal shell extends above the frayed end on the center electrode and has it's frayed end angled downwardly so that the respective ends are in alignment.

5. A spark plug as set forth in claim 3 in which said non-conductive sealant comprises at least one "O" ring.

6. A spark plug as set forth in claim 5 in which the electrode on the outer ferrous metal shell extends above the end on the center electrode and has it's end angled downwardly so that the respective ends are in alignment.

7. A spark plug for igniting a fuel-air mixture, having upper and lower ends, comprising an outer ferrous metal hardened shell having a threaded portion on it's lower end, an inner core of insulating material having a bore therethrough fitting tightly within said shell and extending above and below said shell, a center electrode comprising a length of twisted stainless steel wires fitting tightly within the bore in the insulating material and extending completely therethrough from said upper end to said lower end, said center electrode extending beyond the lower threaded shell portion and having it's extreme lower end portion tightly wound and cleanly cut and suitably spaced from said threaded shell portion, at least one twisted stainless steel double ended wire having one of it's ends attached to the lower end tightly twisted shell portion and having it's other and tightly twisted and cleanly cut and spaced from the end of the center electrode, whereby when ignition occurs, the spark to ignite the fuel-air mixture will bridge the end of the central electrode and the wire attached to the end portion of the threaded shell and cause combustion.

8. A spark plug as set forth in claim 7, in which the cleanly cut ends on the stainless steel twisted wires have solid balls of metal formed thereon to bind all said wires together, said balls of metal being formed by welding, brazing, liquid soldering and the like.

* * * * *